United States Patent [19]

Fong

[11] Patent Number: 4,681,790

[45] Date of Patent: Jul. 21, 1987

[54] TREATING COMPOSITION CONTAINING FLUOROCHEMICAL COMPOUND MIXTURE AND TEXTILES TREATED THEREWITH

[75] Inventor: James J. Fong, Woodbury, Minn.

[73] Assignee: Minnesota Mining and Manufacturing Company, St. Paul, Minn.

[21] Appl. No.: 825,530

[22] Filed: Feb. 3, 1986

[51] Int. Cl.[4] ..... B32B 27/00

[52] U.S. Cl. ..... 428/96; 427/393.4; 428/260; 428/262; 428/265; 428/267; 428/272; 428/290; 428/421; 428/422; 106/2; 252/8.7

[58] Field of Search ..... 428/96, 260, 262, 265, 428/267, 272, 290, 421, 422; 427/393.4; 525/3, 5, 6

[56] References Cited

U.S. PATENT DOCUMENTS

| | | | |
|---|---|---|---|
| 3,574,791 | 4/1971 | Sherman et al. | 260/884 |
| 3,728,151 | 4/1973 | Sherman et al. | 117/138.8 |
| 3,816,167 | 6/1974 | Schultz et al. | 117/138.8 F |
| 3,916,053 | 10/1975 | Sherman et al. | 428/96 |
| 4,043,923 | 8/1977 | Loudas | 252/8.75 |
| 4,043,964 | 8/1977 | Sherman et al. | 260/29.6 F |
| 4,160,777 | 7/1979 | Loudas | 260/456 F |
| 4,264,484 | 4/1981 | Patel | 260/29.6 |

*Primary Examiner*—Marion E. McCamish

*Attorney, Agent, or Firm*—Donald M. Sell; James A. Smith; Richard Francis

[57] ABSTRACT

The invention provides a treating composition comprising (a) a compound having the formula

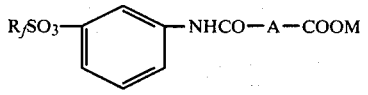

where $R_f$ is a fluorinated aliphatic radical;

A is a divalent radical obtained by eliminating the carbonyl groups of a dibasic organic acid or an organic anhydride selected from the group consisting of tetrachloro phthalic, tetrabromo phthalic and chlorendic; and M is a cation selected from the group consisting of $NH_4^+$, $Na^+$, $K^+$, $Li^+$, $H^+$, or a protonated alkyl amine having from 1–6 carbon atoms in the alkyl group;

(b) a normally liquid or low melting solid, water soluble or dispersible, fluoroaliphatic radical-containing poly(oxyalkylene) compound; and (c) the balance of 100 parts of a liquid vehicle.

A method of treating substrates and substrates treated with the treating composition are also provided.

19 Claims, No Drawings

TREATING COMPOSITION CONTAINING FLUOROCHEMICAL COMPOUND MIXTURE AND TEXTILES TREATED THEREWITH

TECHNICAL FIELD

This invention relates to treating composition containing fluorochemical compounds to impart water and oil repellency as well as soil resistance and to textiles and other materials treated therewith.

BACKGROUND ART

The treatment of textiles such as carpeting with fluorochemicals containing fluoroaliphatic radicals (sometimes designated by the symbol "$R_f$") to impart water and oil repellency has been known for some time. For example, Sherman and Smith (U.S. Pat. No. 3,574,791), Sherman and Smith (U.S. Pat. No. 3,728,151), Schultz and Sherman (U.S. Pat. No. 3,816,167), Sherman and Smith (U.S. Pat. No. 3,916,053), Sherman and Smith (U.S. Pat. No. 4,043,964) and Patel (U.S. Pat. No. 4,264,484) disclose various fluorochemical textile treatments. Such treatments, however, are mainly intended for mill treatment of the textile where treatment steps such as heating are conveniently applied and are not generally suited for use after the textile article has been soiled in use. Loudas (U.S. Pat. Nos. 4,043,923 and 4,160,777) disclose certain detergent-compatible fluorochemical compounds and treating fabric therewith. All of these patents are assigned to the assignee of the present application.

While certain of the references disclose fluorochemical compounds or treatments which may be applied to carpeting, certain of the chemical compositions and treatments have now been found to be somewhat inconvenient to be easily dispensed from a conventional dispensing device such as an aerosol container by untrained personnel such as a homeowner or apartment dweller for use on household textiles such as carpeting, furniture fabric, and the like.

DISCLOSURE OF THE INVENTION

The present invention provides a novel composition for the fluorochemical treatment of various substrates such as textiles (e.g., carpeting, upholstery and the like) concrete, paper, leather, wood, etc., to impart water and oil repellency and stain resistance thereto. The compositions of the invention are conveniently formulated to be contained in and dispensed from conventional dispensing devices such as self pressurized aerosol spray containers or hand pumped spray containers.

The novel compositions of the present invention comprise a blend of two known fluorochemical compounds and fabric-inert liquid vehicle to produce a new composition with unexpected properties. One of the fluorochemical compounds (hereinafter sometimes referred to as a compound of the "Fluorochemical A" type) is known to be useful in combination with surfactants and/or detergents to provide textiles with water and oil repellency and stain resistance. The other fluorochemical compound (hereinafter sometimes referred to as a compound of the "Fluorochemical B" type) is a fluoroaliphatic radical-containing poly(oxyalkylene) which has been known to be mill applied to various textiles such as carpeting but only with the application of heat.

Quite surprisingly, it has been found that the combination of these two fluorochemical compounds results in at least a two-fold synergistic improvement in water and oil repellency and stain resistance. The composition is also quite surprisingly conveniently formulated to be dispensed from an aerosol container and may be applied by an untrained applicator such as a homeowner or apartment dweller merely by spraying the composition on the textile material, without requiring any inconvenient curing steps such as heating. The composition of the invention provides, upon evaporation of the liquid vehicle, a treated textile surface which has oil and water repellency and stain resistance.

More specifically, the fabric treating composition comprises (a) at least about 0.7 part, and preferably from about 0.7 to about 9 parts, by weight of hereinafter defined Fluorochemical A compound;

(b) at least about 0.1 part, preferably 0.1 to 6 parts, by weight of hereinafter defined Fluorochemical B compound; and (c) the balance of 100 parts by weight of the composition of a substrate-inert liquid vehicle capable of dissolving and/or dispersing Fluorochemical Compounds A and B in at least the amounts specified.

Fluorochemical A compound is represented by the general formula

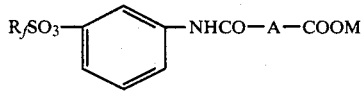

I wherein:

A is a divalent radical obtained by eliminating the carbonyl groups of a dibasic organic acid or an organic anhydride selected from the group consisting of tetrachloro phthalic, tetrabromo phthalic and chlorendic; and M is a cation selected from the group consisting of $NH_4^+$, $Na^+$, $K^+$, $Li^+$, $H^+$, or a protonated alkyl amine having from 1–6 carbon atoms in the alkyl group, and is most preferably $NH_4^+$, $Na^+$ and $K^+$.

Fluorochemical B is a normally liquid or low melting solid, water soluble or dispersible, fluoroaliphatic radical-containing poly(oxylakylene) compound, or a composition comprising or consisting essentially of mixtures of such oxyalkylene compounds, which compound has one or more monovalent fluoroaliphatic radical ($R_f$) and one or more poly(oxyalkylene) moieties, such radicals and oxyalkylene moieties being bonded together by hetero atom-containing groups or organic linking groups, or combinations of such groups.

In Fluorochemical A compound and Fluorochemical B compound the fluoroaliphatic radical, $R_f$, is a fluorinated, stable, inert, non-polar, preferably saturated, monovalent moiety which is both oleophobic and hydrophobic. It can be straight chain, branched chain, and, if sufficiently large, cyclic, or combinations thereof, such as alkylcycloaliphatic radicals. The skeletal chain can include catenary oxygen, hexavalent sulfur, and/or trivalent nitrogen hetero atoms bonded only to carbon atoms, such hetero atoms providing stable linkages between fluorocarbon portions of $R_f$ and not interfering with the inert character of the $R_f$ radical. While $R_f$ can have a large number of carbon atoms, compounds where $R_f$ is not more than 20 carbon atoms will be adequate and preferred since large radicals usually represent a less efficient utilization of fluorine than is possible with smaller $R_f$ radicals. The large radicals also are generally less soluble in organic solvents. Generally, $R_f$ will have 3 to 20 carbon atoms, preferably 6 to about 12, and will contain 20 to 78 weight percent, preferably 50 to 78 weight percent, fluorine. The terminal portion of the $R_f$ group has at least three fully fluorinated carbon atoms, e.g., $CF_3CF_2CF_2$—, and the preferred compounds are those in which the $R_f$ group is fully or substantially completely fluorinated, as in the case where $R_f$ is perfluoroalkyl, $C_nF_{2n+1}$. The most preferred $R_f$ radical is —$C_8F_{17}$.

The invention also includes a substrate, e.g., fabric treated with the composition disclosed above wherein the liquid vehicle has evaporated to leave residual fluorochemical material to impart oil/water repellency and stain resistance properties.

BEST MODE FOR CARRYING OUT THE INVENTION

The compounds of the Fluorochemical A type are disclosed in the aforementioned Loudas patent (U.S. Pat. No. 4,160,777), the disclosure of which is incorporated herein by reference.

The most preferred compound of the Fluorochemical A type is

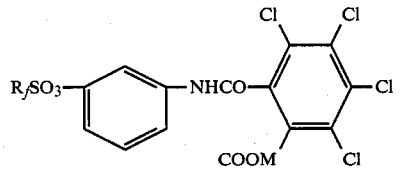

where M is $K^+$, $Na^+$, or $NH_4^+$.

Fluorochemical B is a fluoroaliphatic oligomer (or polymer, the term oligomer hereinafter including polymer unless otherwise indicated) represented by the general formula:

$$(R_f)_sZ[(R^3)_yZ'B]_t \qquad \text{II}$$

$$[(R_f)_sZ[(R^3)_yZ'B']_t]_w \qquad \text{III}$$

where $R_f$ is a fluoroaliphatic radical like that previously described,

Z is a linkage through which $R_f$ and $(R^3)_y$ moieties are covalently bonded together, $(R^3)y$ is a poly(oxyalkylene) moiety, $R^3$ being an oxyalkylene group with 2 to 4 carbon atoms and y is an integer (where the above formulas are those of individual compounds) or a number (where the above formulas are those of mixtures) at least 5, generally 10 to 75 and can be as high as 100 or higher, B is a hydrogen atom or a monovalent terminal organic radical, B' is B or a valence bond, with the proviso that at least one B' is a valence bond interconnecting a Z-bonded $R^3$ radical to another Z, Z' is a linkage through which B, or B', and $R^3$ are covalently bonded together, s is an integer or number of at least 1 and can be as high as 25 or higher, t is an integer or number of at least 1, and can be as high as 60 or higher, and w is an integer or number greater than 1, and can be as high as 30 or higher.

In formulas II and III, where there were a plurality of $R_f$ radicals, they are either the same or different. This also applies to a plurality of Z, Z', $R^3$, B, B', and, in formula III, a plurality of s, y and t.

Generally, the oligomers will contain about 5 to 40 weight percent, preferably about 10 to 30 weight percent, of carbon-bonded fluorine. If the fluorine content is less than about 10 weight percent, impractical large amounts of the oligomer will generally be required, while fluorine contents greater than about 35 weight percent result in oligomers which have too low a solubility to be efficient.

In the poly(oxyalkylene) radical, $(R^3)_y$, $R^3$ is an oxyalkylene group having 2 to 4 carbon atoms, such as —$OCH_2CH_2$—, —$OCH_2CH_2CH_2$—, —$OCH(CH_3)CH_2$—, and —$OCH(CH_3)CH(CH_3)$—, the oxyalkylene units in said poly(oxyalkylene) being the same, as in poly(oxypropylene), or present as a mixture, as in a heteric straight or branched chain or randomly distributed oxyethylene and oxypropylene units or as in a straight or branched chain of blocks of oxyethylene units and blocks of oxypropylene units. The poly(oxyalkylene) chain can be interrupted by or include one or more catenary linkages. Where said catenary linkages have three or more valences, they provide a means for obtaining a branched chain or oxyalkylene units. The poly(oxyalkylene) radicals in the oligomers can be the same or different, and they can be pendent. The molecular weight of the poly(oxyalkylene) radical can be about 500 to 2500 and higher, e.g, 100,000 to 200,000 or higher.

The function of the linkages Z and Z' is to covalently bond the fluoroaliphatic radicals, $R_f$, the poly(oxyalkylene) moieties, $(R^3)_y$ and radicals B and B' together in the oligomer. Z and Z' can be a valence bond, for example, where a carbon atom of a fluoroaliphatic radical is bonded or linked directly to a carbon atom of the poly(oxyalkylene) moiety. Z and Z' each can also comprise one or more linking groups such as polyvalent aliphatic and polyvalent aromatic, oxy, thio, carbonyl, sulfone, sulfoxy, phosphoxy, amine, and combinations thereof, such as oxyalkylene, iminoalkylene, iminoarylene, sulfoamido, carbonamido, sulfonamidoalkylene, carbonamidoalkylene, urethane, urea, and ester. The linkages Z and Z' for a specific oligomer will be dictated by the ease of preparation of such an oligomer and the availability of necessary precursors thereof.

From the above description of Z and Z' it is apparent that these linkages can have a wide variety of structures, and in fact where either is a valence bond, it doesn't even exist as a structure. However large Z or Z' is, the fluorine content (the locus of which is $R_f$) is in the aforementioned limits set forth in the above description, and in general the total Z and Z' content of the oligomer is preferably less than 10 weight percent of the oligomer.

The monovalent terminal organic radical, B, is one which is covalently bonded through Z', to the poly(oxyalkylene) radical.

Though the nature of B can vary, it preferably is such that it complements the poly(oxyalkylene) moiety in maintaining or establishing the desired solubility of the oxyalkylene. The radical B can be a hydrogen atom, acyl, such as $C_6H_5C(O)$—, alkyl, preferably lower alkyl, such as methyl, hydroxyethyl, hydroxypropyl, mercaptoethyl and aminoethyl, or aryl, such as phenyl, chlorophenyl, methoxyphenyl, nonylphenyl, hydroxyphenyl, and aminophenyl. Generally, Z'B will be less than 50 weight percent of the $(R^3)_yZ'B$ moiety.

The fluoroaliphatic radical-containing oxyalkylene used in this invention can be prepared by a variety of known methods, such as by condensation, free radical, or ionic homopolymerization or copolymerization using solution, suspension, of bulk polymerization techniques, e.g., see "Preparative Methods of Polymer Chemistry", Sorenson and Campbell, 2nd ed., Interscience Publishers, (1968). Classes of representative oxyalkylene useful in this invention include polyesters, polyurethanes, polyepoxides, polyamides and vinyl polymers such as polyacrylates and substitute polystyrenes.

The polyacrylates are a particularly useful class of oxyalkylenes and they can be prepared, for example, by free radical initiated copolymerization of a fluoroaliphatic radical-containing acrylate with a poly(oxyalkylene) acrylate, e.g., monoacrylate or diacrylate or mixtures thereof. As an example, a fluoroaliphatic acrylate, $R_f—R''—O_2C—CH=CH_2$ (where R'' is, for example, sulfonamido alkylene, carbonamidoalkylene, or alkylene), e.g., $C_8F_{17}SO_2N(C_4H_9)CH_2CH_2O_2CCH=CH_2$, can be copolymerized with a poly(oxyalkylene) monoacrylate, $CH_2=CHC(O)(R^3)_xOCH_3$, to produce a polyacrylate oxyalkylene.

Further description of fluorochemical oxyalkylenes useful in this invention will be omitted in the interest of brevity since such compounds and their preparation are known, said U.S. Pat. No. 3,787,351 and U.S. Pat. No. 4,289,892, both of which are incorporated herein for that purpose. The most preferred compound of the Fluorochemical B type is a poly(oxyalkylene) copolymer of (a) $C_8F_{17}SO_2N(CH_3)C_2H_4OCOCH=CH_2$, (b) $CH_2=C(CH_3)COO(CH_2CH_2O)_{90}H$, and (c) $CH_2=C(CH_3)COO(CH_2CH_2O)_{90}COC(CH_3)=CH_2$, preferably in a 1:1 weight ratio of a:(b+c) and a 3:1 weight ratio of b:c.

The liquid vehicle is a blend of a major portion of water and a minor portion of an organic water-miscible solvent of the fluorocarbon compounds. The organic solvent preferably has low toxicity and flammability and an adequate rate of evaporation to permit removal after application. Useful organic solvents which have a low degree of toxicity include the glycol ethers such as propylene glycol methyl ether and diethylene glycol butyl ether available under the trade designation "Dowanol" series from Ashland Chemical Corporation. The organic solvent preferably is selected to have a flash point of not less than 56° C. The preferred organic solvent is a blend of propylene glycol methyl ether and diethylene glycol butyl ether to provide a flash point of about 56° C. Excessive quantities of propylene glycol methyl ether would reduce the flash point below the preferred 56° C. temperature. Too much diethylene glycol butyl ether may retard evaporation and interfere with the oil and water repellency. The preferred liquid vehicle is 4% propylene glycol methyl ether, 3% diethylene glycol butyl ether and the balance of 100% by weight of water.

For use, typical concentrations of the active ingredients will be on the order of about 0.7 to 9 parts of Fluorochemical A and about 0.1 to 6 parts by weight Fluorochemical B. These amounts may be greater for a concentrated solution, depending upon the solubility or dispersibility of the fluorochemical compounds.

Once applied, excellent water and oil repellency and stain resistance are obtained on substrates such as textile (e.g., carpeting) having a dry add-on weight of at least 0.5 g per $m^2$ of fluorochemical compound, preferably 2.5 to 5.0 grams per $m^2$.

The treating compositions according to the invention may contain other ingredients which increase effectiveness or improve physical appearance. For example, these compositions may contain ingredients which make the compositions more suitable for use and less susceptible to degradation or alteration in an aerosol can. Such ingredients include corrosion inhibitors such as sodium nitrite and/or morpholine to inhibit can corrosion, a chelating agent such as that available under the trade designation "Versenol" 120 to inhibit metallic contamination caused by leaching of the can wall during long term storage. Minor amounts of additives such as about 1% by weight of 3,5-dimethyl-1-hexyne-3-01 available under the trade designation "Sulfonyl" 61, n-pentanol, or cyclohexanol to stabilize the composition to improve shelf-life and prevent precipitaton and sedimentation. Other ingredients such as fragrances, germicidal materials, and the like may also be added.

In use, the diluted treating composition is typically applied to the surface being treated using conventional application equipment. The treating solution may be sprayed upon the surface by conventional spraying devices. The preferred means of spraying is by an aerosol dispensing container which includes a sufficient charge of the treating composition and a sufficient amount of aerosol propellant to dispense the solution. Such propellants are typically low boiling chlorofluoro-substituted alkanes (e.g., "Freon" 12, or low boiling alkanes or mixtures thereof such as a mixture of isobutane and propane.

Substrates which can be treated in accordance with this invention are textile fibers (or filaments), and finished or fabricated fibrous articles such as textiles, e.g., carpet, paper, paperboard, leather, and the like. The textiles include those made of natural fibers, such as cotton and wool, and those made of synthetic organic fibers, such as nylon, polyolefin, acetate, rayon, acrylic, and polyester fibers. Especially good results are obtained on nylon and polyester fibers or fabric. Articles such as carpet and woven fabrics can be treated with the treating composition of the invention.

EXAMPLES

The invention is further illustrated by the following examples wherein all parts are by weight unless otherwise indicated.

STARTING MATERIALS

Fluorochemical compound solutions (FCS) Nos. 1–3 used in the preparation of the Examples were as follows:

| Parts by Weight | Ingredient |
|---|---|
| | FCS NO.1 |
| 30 | hybrid copolymer of equal parts of A and B monomers |
| | (A) $C_8F_{17}SO_2N(CH_3)C_2H_4OCOCH=CH_2$; and |
| | (B) methacrylate esters of a polyethylene glycol of |

-continued

| Parts by Weight | Ingredient |
|---|---|
| | molecular weight of about 4000 (Carbowax ®4000) comprising (a) $CH_2{=}C(CH_3)COO(CH_2CH_2O)_{90}H$; and (b) $CH_2{=}C(CH_3)COO(CH_2CH_2O)_{90}{-}COC(CH_3){=}CH_2$ in a ratio of a:b of about 3:1. |
| 7 | Polyethylene glycol having a molecular weight of about 4000 (Carbowax ®4000) |
| 55 | Water |
| 7 | Ethylene glycol |
| 1 | Ethyl acetate |
| | uz,13/20 FCS NO. 2 |
| 20 | Hybrid copolymer of 65 parts monomer A (defined in FCS No. 1) and 35 parts monomer C, as follows: $CH_3O(CH_2CH_2O)_{16}COCH{=}CH_2$ prepared from Carbowax ®750 |
| 80 | Water |
| Trace | Ethyl acetate |
| | FCS NO. 3 |
| 27 | Tetrachlorophthalic anhydride/ m-aminophenol perfluorooctyl sulfonate addition product of the potassium salt |
| 18 | Ethylene glycol monobutyl ether (Butyl Cellosolve ®) |
| 18 | Isopropyl alcohol |
| | Test Solution |
| See TABLE I | Fluorochemical solution |
| 4.00 | Propylene glycol methyl ether (Dowanol ®PM) |
| 1.00 | 3,5-dimethyl-1-hexyne-3-01 (Sulfonyl ®61) |
| 3.00 | Diethylene glycol n-butyl ether (Dowanol ®DB) |
| 0.05 | Sodium nitrite |
| 0.05 | Morpholine |
| 0.001 | Fragrance (Honeysuckle #351OH) |
| 0.01 | Aqueous solution of the trisodium salt of N—hydroxyethylenediamine-acetic acid (Versenol ®120) |
| Balance to 100 | Water |

The sodium nitrite was dissolved in water at 25° C. in a stainless steel kettle equipped with a thermometer and a variable speed mixer. Then were added in order morpholine, "Versenol" 120, "Dowanol" PM, "Sulfonyl" 61, and "Dowanol" DB. The fluorochemical solution and the fragrance were then added. The resultant mixture was then stirred for at least 20 minutes until it became homogeneous. This solution was charged into a 20 ounce (566 ml) tin-plated epoxy phenolic resin lined aerosol can with isobutane as propellant. The weight ratio of fill solution to isobutane was on the order of 95:5 to 90:10, preferably 93:7.

TESTING

The examples according to the present invention and the control examples described in Table I were used on test fabric samples which were evaluated for oil repellency, and water repellency. The test fabrics are designated as "nylon" which was a test fabric identified as "nylon 361" woven from spun nylon 66 available from E. I. duPont de Nemours in a type 200 woven fabric pattern and "polyester" which was a 100% "Dacron" polyester woven in a type 54 pattern. Both test samples were obtained from Test Fabrics of America, Inc. of Middlesex, N.J. The test fabrics were factory scoured and prepared for use without adding optical bleach.

The water repellency test is one which is often used for this purpose. The aqueous stain or water repellency of treated sample is measured using a water/isopropyl alcohol test, and is expressed in terms of a water repellency rating of the treated fabric. Treated fabrics which are penetrated by or resistant only to a 100 percent water/zero percent isopropyl alcohol mixture (the least penetrating of the test mixtures) are given a rating of 100/0, whereas treated fabrics resistant to a zero percent water/100 percent isopropyl alcohol mixture (the most penetrating of the test mixtures) are given a rating of 0/100. Other intermediate values are determined by use of other water/isopropyl alcohol mixtures, in which the percentage amounts of water and isopropyl alcohol are each multiples of 10. Results are reported as an average of replicate testing. The water repellency rating corresponds to the most penetrating mixture which does not penetrate or wet the fabric after 30 seconds contact. In general, a water repellency rating of 90/10 or better, e.g., 80/20, is desirable for fabric.

The oil repellency test is also one which is often used for this purpose. The oil repellency of treated carpet and textile sample is measured by the American Association of Textile Chemists and Colorists (AATCC) Standard Test Method No. 118-1983, which test is based on the resistance of treated fabric to penetration by oils of varying surface tensions. Treated fabrics resistant only to "Nujol", a brand of mineral oil and the least penetrating of the test oils, are given a rating of 1, whereas treated fabrics resistant to heptane (the most penetrating of the test oils) are given a value of 8. Other intermediate values are determined by use of other pure oils or mixtures of oils, as shown in the following table:

Standard Test Liquids

| AATCC OIL Repellency Rating Number | Composition |
|---|---|
| 1 | "Nujol" |
| 2 | 65:35 "Nujol": n-hexadecane by volume @ 70° F. (21° C.) |
| 3 | n-hexadecane |
| 4 | n-tetradecane |
| 5 | n-dodecane |
| 6 | n-decane |
| 7 | n-octane |
| 8 | n-heptane |

The rated oil repellency corresponds to the most penetrating oil (or mixture of oils) which does not penetrate or wet the fabric 30 seconds contact. Higher numbers indicate better oil repellency. In general, an oil repellency of 2 or greater is desirable for fabric.

The carpet soil resistance was evaluated on test samples of scoured, untreated nylon pile carpet available under the trade designation "Discovery Antron" pattern No. L8871 carpet available from Lees Carpet Company, a division of Burlington Industries, according to AATCC Test Method No. 123-1982 entitled "Carpet Soiling: Accelerated Soiling Method".

The test method involves spraying 80.7 g/m$^2$ of the test composition on one-half of the area of a 30 by 50 cm test carpet specimen and leaving the other one half untreated. The carpet samples were then tumbled together with 0.2 g artificial soil described below in a laboratory ball mill for 20 minutes. The carpet samples were then removed from the ball mill and cleaned with a conventional vacuum cleaner to remove excess soil. The degree of difference between an original or clean area and the area under examination is determined by visual matching with a stepwise series of differences in gray chips selected to form a geometrical scale of differences on the light-dark axis according to AATCC test Method No. 121-1982 "Carpet Soiling" Visual Rating Method".

The evaluation procedure involved placing a clean reference carpet specimen on the soiled specimen to be examined, or beside it, with no gap between the specimens. The two specimens were oriented in the same way with respect to the structure and pattern. A standard lighting system including a daylight and an artificial light source was used. Pairs of chips in the gray scale were compared with the pair of specimens, until the nearest corresponding pair of chips has been found. A dark shield was used to expose only one pair of chips at a time. The chip step number or half step number which most nearly corresponds in difference to the difference in cleanness between the specimens was recorded. At least 4 observers repeated the ratings. The averaged ratings are reported in Table II to the nearest 0.1 scale unit. The average rating of cleanness ranged from 5, no difference between the clean standard and the soiled treated specimen, to 1, the largest difference between the standard and the soiled treated test specimen.

| Artificial Soil Formula | |
|---|---|
| Ingredient | (g) |
| Ground peat moss and iron oxide | 53.61 |
| Methylmethacrylate-ethylemethacrylate | 36.36 |
| Dioctylphthalate | 8.08 |
| Filter gel | 203.63 |
| Grey Portland cement | 72.72 |
| Magnesium oxide | 16.56 |

-continued

| Artificial Soil Formula | |
|---|---|
| Ingredient | (g) |
| Potassium carbonate | 17.78 |
| Sodium carbonate | 39.19 |
| Polyethylene resin | 18.18 |
| Darco ®G-60 activated carbon | 6.06 |
| | 472.16 |

The ingredients were added in order to one gallon paint can, tumbled on a roller mill with about 50 ceramic cylinders (1.91 cm, ¾ inch) for about forty-five minutes, and filtered through a 42 mesh sieve having nominal openings of about 394 micrometers.

The compositions according to the present invention were also tested under normal foot traffic in a controlled test area by employing American National Standard Test Method (AATCC Test Method 122-1982) entitled "Carpet Soiling: Service Soiling Method". In this test specimens of carpet and selected control samples were exposed to normal foot traffic in a controlled test area. The test specimens and controls were removed at predetermined intervals corresponding to different degrees of soiling or exposure to soiling. Specimen preparation is similar to that described in the Accelerated Soiling Test method. Rating of these test results is also similar to that described in the Accelerated Soiling Test method.

Compositions according to the claimed invention are described in Table I, as are control compositions and the test results of evaluating such compositions.

TABLE I

| | | | Test Results | | | | | |
|---|---|---|---|---|---|---|---|---|
| | | Concentration | Water/IPA | | Oil Repellency | | Accelerated | Service |
| Ex.[1] | FCS No. | w/w | Nylon | Polyester | Nylon | Polyester | Soiling Test[2] | Soiling Test[2] |
| A | none | none | 0 | 0 | 0 | 0 | 0 | 0 |
| B | 3 | 0.7 | 100/0 | 90/10 | 1 | 2 | — | — |
| C | 3 | 2.0 | 0 | 100/0 | 1 | 1 | — | — |
| D | 3 | 2.0 | 0 | 90/10 | 0 | 1 | — | — |
| E | 3 | 3.0 | 100/0 | 90/10 | 3 | 4 | 0.62 | 0.76 |
| F | 3 | 6.0 | 90/10 | 100/0 | 4 | 6 | 0.38 | 0.63 |
| G | 3 | 9.0 | 100/0 | 90/10 | 5 | 6 | 0.13 | 0.63 |
| H | 2 | 0.1 | 0 | 0 | 0 | 0 | — | — |
| I | 2 | 0.5 | 0 | 0 | 0 | 0 | — | — |
| J | 2 | 1.0 | 0 | 0 | 0 | 0 | 0.13 | 0.51 |
| K | 2 | 3.0 | 0 | 0 | 0 | 0 | −0.13 | 0.28 |
| L | 2 | 6.0 | 100/0 | 0 | 1 | 3 | −0.25 | 0.00 |
| M | 1 | 1.0 | 100/0 | 0 | 1 | 0 | — | — |
| 1 | 2 | 0.1 | 90/10 | 90/10 | 5 | 6 | — | — |
| | 3 | 9.0 | | | | | | |
| 2 | 2 | 0.5 | 90/10 | 90/10 | 5+ | 5+ | — | — |
| | 3 | 9.0 | | | | | | |
| 3 | 2 | 1.0 | 80/20 | 70/30 | 5 | 6 | 0.75 | 1.13 |
| | 3 | 9.0 | | | | | | |
| 4 | 2 | 1.0 | 90/10 | 80/20 | 5 | 6 | 0.50 | 0.63 |
| | 3 | 6.0 | | | | | | |
| 5 | 2 | 1.0 | 90/10 | 80/20 | 5 | 5+ | 0.38 | 0.50 |
| | 3 | 3.0 | | | | | | |
| 6 | 2 | 1.0 | 80/20 | 70/30 | 6 | 6 | 0.75 | 1.13 |
| | 3 | 9.0 | | | | | | |
| 7 | 2 | 6.0 | 100/0 | 90/10 | 5 | 6 | 0.75 | 0.50 |
| | 3 | 3.0 | | | | | | |
| 8 | 2 | 6.0 | 90/10 | 80/20 | 6 | 5+ | 0.5 | 0.87 |
| | 3 | 6.0 | | | | | | |
| 9 | 2 | 6.0 | 80/20 | 80/20 | 6 | 7 | 0.25 | 0.50 |
| | 3 | 9.0 | | | | | | |
| 10 | 1 | 1.0 | 80/20 | 80/20 | 5+ | 6 | — | — |
| | 3 | 9.0 | | | | | | |

[1]Examples A–M are control examples

[2]Results are differences in rating between the test sample and the untreated control.

Examples according to the invention, Examples 1–10, show that a synergistic result is obtained by using a treating composition with Fluorochemical A and Fluorochemical B as compared with treating compositions which use only one of these fluorochemicals as demonstrated by Control Examples A–M.

What is claimed is:

1. A treating composition comprising (a) at least about 0.7 parts by weight of a compound having the formula

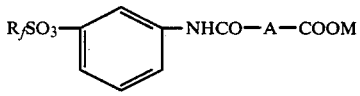

where $R_f$ is a fluorinated aliphatic radical;

A is a divalent radical obtained by eliminating the carbonyl groups of a dibasic organic acid or an organic anhydride selected from the group consisting of tetrachloro phthalic, tetrabromo phthalic and chlorendic; and M is a cation selected from the group consisting of $NH_4^+$, $Na^+$, $K^+$, $Li^+$, $H^+$, or a protonated alkyl amine having from 1–6 carbon atoms in the alkyl group;

(b) at least about 0.1 part by weight of a normally liquid or low melting solid, water soluble or dispersible, fluoroaliphatic radical-containing poly(oxyalkylene) compound, or composition comprising a mixture of such poly(oxyalkylene) compounds, said poly(oxyalkylene) compound having one or more of said fluoroaliphatic radicals and one or more poly(oxyalkylene) moieties, said fluoroaliphatic radicals and poly(oxyalkylene) moieties being bonded together by hetero atom-containing groups or organic linking groups or combinations of said groups; and (c) the balance of 100 parts of a substrate-inert liquid vehicle capable of dissolving and/or dispersing said compound and said fluoroaliphatic radical-containing poly(oxyalkylene) in at least the amounts specified.

2. The treating composition of claim 1 wherein said fluoroaliphatic radical-containing poly(oxyalkylene) has the general formula $$(R_f)_sZ[(R^3)_yZ'B]_t \text{ or } [(R_f)_sZ[(R^3)_yZ'B']_t]_w$$

where $R_f$ is said fluoroaliphatic radical,

Z is linkage through which $R_f$ and $(R^3)_y$ are covalently bonded together, $(R^3)_y$ is a poly(oxyalkylene) moiety, $R^3$ being oxyalkylene with 2 to 4 carbon atoms, and y is an integer or number of at least 5 and can be as high as 100 or higher, B is a monovalent terminal organic radical, B' is B or a valence bond, with the proviso that at least one B' is a valence bond interconnecting a Z-bonded $(R^3)_y$ radical to another Z, Z' is a linkage through which B or B' and $(R^3)_y$ are covalently bonded together, s is an integer or number of at least 1 and can be as high as 25 or higher, t is an integer or number of at least 1 and can be as high as 60 or higher, and w is an integer or number greater than 1 and can be as high as 30 or higher.

3. The treating composition of claim 1 wherein said fluorochemical poly(oxyalkylene) is the copolymer of $$C_8F_{17}SO_2N(CH_3)C_2H_4OCOCH{=}CH_2,$$

$$CH_2{=}C(CH_3)COO(CH_2CH_2O)_{90}H,$$

and $$CH_2{=}C(CH_3)COO(CH_2CH_2O)_{90}COC(CH_3){=}CH_2.$$

4. The treating composition of claim 1 wherein said (a) compound is

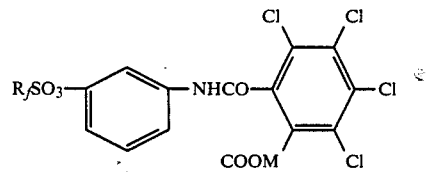

where M is $K^+$, $Na^+$, or $NH_4^+$.

5. The treating composition of claim 4 wherein $R_f$ is $C_8F_{17}$.

6. The composition of claim 1 wherein the concentration of said (a) compound in said composition is in the range of about 0.7 part by weight to 9 parts by weight per 100 parts by weight of said composition.

7. The composition of claim 1 wherein the concentration of said fluoroaliphatic radical-containing poly(oxyalkylene) compound is 0.1 part by weight to 6 parts by weight per 100 parts by weight of said composition.

8. The composition of claim 1 wherein said liquid vehicle comprises water, propylene glycol methyl ether, and diethylene glycol butyl ether.

9. An aerosol dispersible composition comprising the composition of claim 1 in an aerosol dispensing container including an aerosol dispensing means.

10. Method of treating a substrate comprising applying the composition of claim 1 to said substrate and drying to substantially remove said liquid vehicle.

11. The method of claim 10 wherein said substrate is fabric.

12. The method of claim 11 wherein said fabric is carpet.

13. A substrate treated with a composition comprising a blend of (a) a compound having the formula

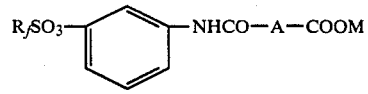

where $R_f$ is a fluorinated aliphatic radical;

A is a divalent radical group obtained by eliminating the carbonyl groups of a dibasic organic acid or an organic anhydride selected from the group consisting of tetrachloro phthalic, tetrabromo phthalic and chlorendic; and M is a cation selected from the group consisting of $NH_4^+$, $Na^+$, $K^+$, $Li^+$, $H^+$, or a protonated alkyl amine having from 1–6 carbon atoms in the alkyl group;

(b) a normally liquid or low melting solid, water soluble or dispersible, fluoroaliphatic radical-containing poly(oxyalkylene) compound, or composition comprising a mixture of such poly(oxyalkylene) compounds, said poly(oxyalkylene) compound having one or more of said fluoroaliphatic radicals and one or more poly(oxyalkylene) moieties, said fluoroaliphatic radicals and poly(oxyalkylene) moieties being bonded together by hetero atom-containing groups or organic linking groups or combinations of said groups.

14. The treated substrate according to claim 13 wherein said fluoroaliphatic radical-containing poly(oxyalkylene) compound has the general formula $$(R_f)_sZ[(R^3)_yZ'B]_t \text{ or } [(R_f)_sZ[(R^3)_yZ'B']_t]_w$$

where $R_f$ is said fluoroaliphatic radical,

Z is linkage through which $R_f$ and $(R^3)_y$ are covalently bonded together, $(R^3)_y$ is a poly(oxyalkylene) moiety, $R^3$ being oxyalkylene with 2 to 4 carbon atoms, and y is an integer or number of at least 5 and can be as high as 100 or higher, B is a monovalent terminal organic radical, B' is B or a valence bond, with the proviso that at least one B' is a valence bond interconnecting a Z-bonded $(R^3)_y$ radical to another Z, Z' is a linkage through which B or B' and $(R^3)_y$ are covalently bonded together, s is an integer or number of at least 1 and can be as high as 25 or higher, t is an integer or number of at least 1 and can be as high as 60 or higher, and w is an integer or number greater than 1 and can be as high as 30 or higher.

15. The treated substrate according to claim 13 wherein said fluorochemical poly(oxyalkylene) compound is the copolymer of $$C_8F_{17}SO_2N(CH_3)C_2H_4OCOCH{=}CH_2,$$

$$CH_2{=}C(CH_3)COO(CH_2CH_2O)_{90}H,$$

and $$CH_2{=}C(CH_3)COO(CH_2CH_2O)_{90}COC(CH_3){=}CH_2.$$

16. The treated substrate of claim 13 wherein said (a) compound is

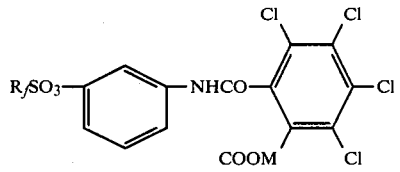

where M is $K^+$, $Na^+$, or $NH_4^+$.

17. The treated substrate of claim 16 wherein $R_f$ is $C_8F_{17}$.

18. The treated substrate of claim 13 wherein said substrate is fabric.

19. The treated substrate of claim 13 wherein said substrate is carpet.

* * * * *

UNITED STATES PATENT AND TRADEMARK OFFICE

CERTIFICATE OF CORRECTION

PATENT NO. : 4,681,790

DATED : July 21, 1987

INVENTOR(S) : Fong

It is certified that error appears in the above-identified patent and that said Letters Patent is hereby corrected as shown below:

Column 2, line 17, delete "0.1 to 6 parts" and insert in its place --0.1 part to 6 parts--.

Column 2, line 42, delete "$Na^+$ and $K^+$" and insert in its place --$Na^+$ or $K^+$--.

Column 2, line 45, delete "poly(oxylakylene)" and insert in its place --poly(oxyalkylene)--.

Column 5, lines 40-41; Column 12, lines 11-12 (Claim 3); and Column 14, lines 14-15 (Claim 15) delete the formula which has been incorrectly and unnecessarily hyphenated and insert the formula to be completed on one line as follows:

$$--CH_2=C(CH_3)COO(CH_2CH_2O)_{90}COC(CH_3)=CH_2--$$

Column 6, line 21, delete "3,5-dimethyl-1-hexyne-3-01" and insert in its place --3,5-dimethyl-1-hexyne-3-ol--.

Column 7, line 15, delete "uz,13/20 FCS NO. 2" and insert in its place --FCS NO. 2--.

UNITED STATES PATENT AND TRADEMARK OFFICE

CERTIFICATE OF CORRECTION

PATENT NO. : 4,681,790

DATED : July 21, 1987

INVENTOR(S) : Fong

It is certified that error appears in the above-identified patent and that said Letters Patent is hereby corrected as shown below:

Column 11, line 60, the subparagraph beginning "B' is B" should not be indented.

Column 11, line 61, beginning "least one" should be indented.

Column 11, line 62, beginning "bonded" should be indented.

Signed and Sealed this

Tenth Day of January, 1989

*Attest:*

*Attesting Officer*

DONALD J. QUIGG

*Commissioner of Patents and Trademarks*